US007695578B2

(12) United States Patent
Horigome et al.

(10) Patent No.: US 7,695,578 B2
(45) **Date of Patent: *Apr. 13, 2010**

(54) BRONZE ALLOY, AND INGOT AND LIQUID-CONTACTING PART USING THE ALLOY

(75) Inventors: Teruhiko Horigome, Yamanashi (JP); Kazuhito Kurose, Yamanashi (JP)

(73) Assignee: Kitz Corporation, Chiba (JP)

( * ) Notice: Subject to any disclaimer, the term of this patent is extended or adjusted under 35 U.S.C. 154(b) by 233 days.

This patent is subject to a terminal disclaimer.

(21) Appl. No.: 10/574,924

(22) PCT Filed: Dec. 2, 2004

(86) PCT No.: PCT/JP2004/017911

§ 371 (c)(1),
(2), (4) Date: Apr. 7, 2006

(87) PCT Pub. No.: WO2005/054527

PCT Pub. Date: Jun. 16, 2005

(65) Prior Publication Data

US 2007/0113935 A1 May 24, 2007

(30) Foreign Application Priority Data

Dec. 3, 2003 (JP) ..... 2003-404900
May 20, 2004 (JP) ..... 2004-149965

(51) Int. Cl.
*C22C 9/02* (2006.01)
*C22C 9/04* (2006.01)

(52) U.S. Cl. ..... 148/433; 420/470; 420/471; 420/472; 420/473

(58) Field of Classification Search ..... 148/433; 420/470, 471, 472, 473
See application file for complete search history.

(56) References Cited

U.S. PATENT DOCUMENTS 5,942,056 A * 8/1999 Singh ..... 148/434

(Continued)

FOREIGN PATENT DOCUMENTS

JP 01-136943 5/1989

(Continued)

OTHER PUBLICATIONS

"13th Year of Heisei (2001) Report on Development of the Lead-free Copper Alloy Casting", *The Materials Process Technology Center Research Report 567* and *The Japan Non-ferrous Alloy Casting Association*, Feb. 28, 2002.

*Primary Examiner*—Sikyin Ip
(74) *Attorney, Agent, or Firm*—Wenderoth, Lind & Ponack, LLP.

(57) ABSTRACT

A copper-based alloy that has the soundness of alloy enhanced by restraining the concentrated occurrence of microporosities while suppressing the lead content and an ingot and a liquid-contacting part using the alloy are provided. The copper-based alloy has the soundness of alloy improved during the course of solidification of the copper-based alloy by crystallizing an intermetallic compound capable of solidifying at a temperature exceeding a solidus line in dendritic gaps of the alloy, suppressing migration of a solute, thereby allowing dispersion of microporosities, utilizing crystallization of the intermetallic compound as well for effecting dispersed crystallization of a low melting metal or a low melting intermetallic compound capable of solidifying at a temperature falling short of a liquidus line, and relying on the low melting metal or low melting intermetallic compound to enter the microporosities and suppress occurrence of microporosities.

7 Claims, 9 Drawing Sheets

U.S. PATENT DOCUMENTS

| | | | | |
|---|---|---|---|---|
| 7,297,215 | B2 * | 11/2007 | Kurose et al. | 148/433 |
| 2002/0159912 | A1 | 10/2002 | Oishi | |

FOREIGN PATENT DOCUMENTS

| | | | |
|---|---|---|---|
| JP | 08-120369 | | 5/1996 |
| JP | 2002-60868 | | 2/2000 |
| JP | 2000-129375 | * | 5/2000 |
| JP | 2000-336442 | | 12/2000 |
| JP | 2002-88427 | * | 3/2002 |
| JP | 2002-159912 | | 6/2002 |
| JP | 2003-147460 | | 5/2003 |
| JP | 2003-193157 | | 7/2003 |

* cited by examiner

Relation between measured position and surface ratio of ZnSe
(Measured value on test piece 20 mm in wall thickness)

Wall thickness of casting and surface ratio of ZnSe
(Measured values at position of center of each test piece)

Relation between measured position and surface ratio of porosities
(Measured value on test piece 20 mm in wall thickness)

Relation between Bi content and microporosities
(Measured values obtained at the center
of each test piece 20 mm in wall thickness)

BRONZE ALLOY, AND INGOT AND LIQUID-CONTACTING PART USING THE ALLOY

TECHNICAL FIELD

This invention relates to a copper-based alloy having the soundness of alloy improved by decreasing the casting defect while suppressing the lead content and an ingot and a liquid-contacting part using the alloy.

BACKGROUND ART

Generally, while the alloy casing is in the process of solidifying, it possibly gives rise to a defect of shrinkage cavity due to volumetric shrinkage. The casting in the process of solidifying begins cooling from the surface and forms the finally solidified part in the central part of wall thickness. In this central part, the liquid phase that awaits solidification is attracted in the direction of the formerly solidified surface part and, as a result, disposed to induce volumetric shrinkage. This defect of shrinkage cavity varies in form with the composition of the relevant alloy, the condition of cooling, etc. Particularly, in the case of such a copper alloy that tends to induce solute segregation (deviation of concentration) and exhibits a wide range of solidifying temperature, the defect possibly occurs in the form of minute shrinkage holes (shrinkage cavity) called microporosities. The technique which crystallizes a low melting metal or intermetallic compound in an alloy with a view to suppressing the occurrence of this defect and securing the pressure resistance expected in ordinary plumbing materials, such as valves, cocks and joints has been known to the art.

In the bronze casting (CAC406 JIS), for example, lead is added and crystallized as a low melting metal. The CAC406 contains about 5% of lead in weight ratio. Since this lead functions to fill up shrinkage holes occurring in the central part, it permits easy production of such a sound casting that does not have many casting defects like shrinkage cavities. Since this casting excels particularly in machinability, it is copiously utilized for liquid-contacting metal parts in the plumbing materials of the kind under discussion. When this bronze alloy is used as the raw material for liquid-contacting metal parts, such as valves, however, the lead that scarcely forms a solid solution in the bronze casting and manages to crystallize has the possibility of eluting into the ambient water and deteriorating the quality of the water. This phenomenon becomes particularly conspicuous when water stagnates in the liquid-contacting metal part.

Thus, the development of the so-called leadless copper alloy is being promoted and has succeeded in proposing several new alloys (refer, for example, to Patent Documents 1 to 4).

JP-B HEI 5-63536 (Patent Document 1), for example, discloses a leadless copper alloy that is enabled by adding Bi in the place of lead in the copper alloy to enhance machinability and prevents dezincification.

Japanese Patent No. 2889829 (Patent Document 2) discloses a leadless bronze which adds Bi for the sake of enhancing machinability and adds Sb to suppress the occurrence of porosities during the course of casting and enhance mechanical strength.

JP-A 2000-336442 (Patent Document 3) discloses a leadless free-cutting bronze alloy that acquires machinability and enhances anti-seizing property by adding Bi and secures resistance to dezincification and mechanical properties by addition of Sn, Ni and P.

JP-A 2002-60868 (Patent Document 4) discloses a leadless bronze alloy which is enabled by adding not more than 1 weight % of Bi and Sb as impurities and taking into consideration the recycling property to secure castability, workability and mechanical properties.

Patent Document 1: JP-B HEI 5-63536

Patent Document 2: Japanese Patent No. 2889829

Patent Document 3: JP-A 2000-336442

Patent Document 4: JP-A 2002-60868

DISCLOSURE OF THE INVENTION

Problem to be Solved by the Invention

The aforementioned leadless copper alloys that have been proposed as described above have incorporated Bi as an alternative component for lead. Since excess addition of Bi not merely adds to cost but also induces degradation of mechanical properties, such as tensile strength and elongation, the amount of Bi to be added is required to be not more than ½ in volumetric ratio as compared with the lead content in the conventional bronze casting. Further, in such an alloy as bronze that has a wide range of solidifying temperature, the solution like Bi is liable to induce inverse segregation that suffers the concentration to deviate on the surface of the casting. Thus, the central part of wall thickness of the casting which constitutes the finally solidified part fails to secure such an amount of Bi that is enough to compensate for the volumetric shrinkage, produces microporosities (the defect of shrinkage cavities) copiously, and possibly entails deterioration of the pressure resistance of alloy.

This invention has been developed in consequence of a diligent study performed in view of the problem mentioned above. It is aimed at providing a copper-based alloy that has the soundness of alloy enhanced by restraining the concentrated occurrence of microporosities while suppressing the lead content and an ingot and a liquid-contacting part using the alloy.

Means to Solve the Problem

To attain the above object, an embodiment of the present invention is directed to a copper-based alloy having soundness of alloy improved during a course of solidification of the copper-based alloy by crystallizing an intermetallic compound capable of solidifying at a temperature exceeding a solidus line in dendritic gaps of the alloy, suppressing migration of a solute, thereby allowing dispersion of microporosities, utilizing crystallization of the intermetallic compound as well for effecting dispersed crystallization of a low melting metal or a low melting intermetallic compound capable of solidifying at a temperature falling short of a liquidus line, and relying on the low melting metal or low melting intermetallic compound to enter the microporosities and suppress occurrence of microporosities.

An embodiment of the present invention is directed to the copper-based alloy containing at least 5.0 to 10.0 weight % of Zn and $0<Se\leqq1.5$ weight % of Se and having ZnSe crystallized as the intermetallic compound in the dendritic gaps of the alloy during the course of solidification of the copper-based alloy.

An embodiment of the present invention is directed to the copper-based alloy, wherein the intermetallic compound has a surface ratio of 0.3% or more and 5.0% or less.

An embodiment of the present invention is directed to the copper-based alloy containing at least 0.25 to 3.0 weight % of Bi and having Bi crystallized as the low melting metal in a region of the solute during the course of solidification of the copper-based alloy.

An embodiment of the present invention is directed to the copper-based alloy, wherein the low melting metal or low melting intermetallic compound has a surface ratio of 0.2% or more and 2.5% or less.

An embodiment of the present invention is directed to the copper-based alloy that comprises at least 5.0 to 10.0 weight % of Zn, 2.8 to 5.0 weight % of Sn, 0.25 to 3.0 weight % of Bi, $0<Se\leqq1.5$ weight % of Se, less than 0.5 weight % of P, the balance of Cu and less than 0.2 weight % of Pb as an unavoidable impurity.

An ingot produced using the copper-based alloy according to an embodiment of the present invention or a liquid-contacting part having the copper-based alloy mechanically formed.

EFFECT OF THE INVENTION

In accordance with an embodiment of the present invention, by dispersing microporosities to prevent the microporosities from occurring concentrically in the central part of an alloy, allowing as well the dispersed low melting metal or low melting intermetallic compound to enter the microporosities, and consequently restraining effectively the occurrence of the microporosities, it is made possible to provide a copper-based alloy that enhances the soundness of alloy and secures a prescribed property of pressure resistance.

In accordance with an embodiment of the present invention, it is made possible to provide a copper-based alloy that suppresses a rare metal content, enhances the soundness of alloy and excels in economy as well.

In accordance with an embodiment of the present invention, it is made possible to provide a copper-based alloy that suppresses a rare metal content, enhances the soundness of alloy and excels in economy as well.

In accordance with an embodiment of the present invention, it is made possible to obtain even in such a bronze that satisfies a prescribed standard lead elution and manifests a wide range of solidifying temperature a copper-based alloy which allows microporosities to be decreased in the central part of wall thickness of the alloy and enhances the soundness of alloy and particularly a copper-based alloy befitting general plumbing materials, such as valves, for example.

In accordance with an embodiment of the present invention, it is made possible to provide an ingot as an intermediate and provide valve parts including valves, stems, valve seats and disks for potable water, plumbing materials including faucets and joints, devices for service and drain pipes including strainers, pumps and motors which are fated to contact liquids, liquid-contacting faucet fittings, hot water-handling devices including hot feed water devices, parts and members for clean water lines, and intermediates including coils and hollow bars other than the finished products and assembled bodies enumerated above.

BEST MODE FOR CARRYING OUT THE INVENTION

Figure 1:
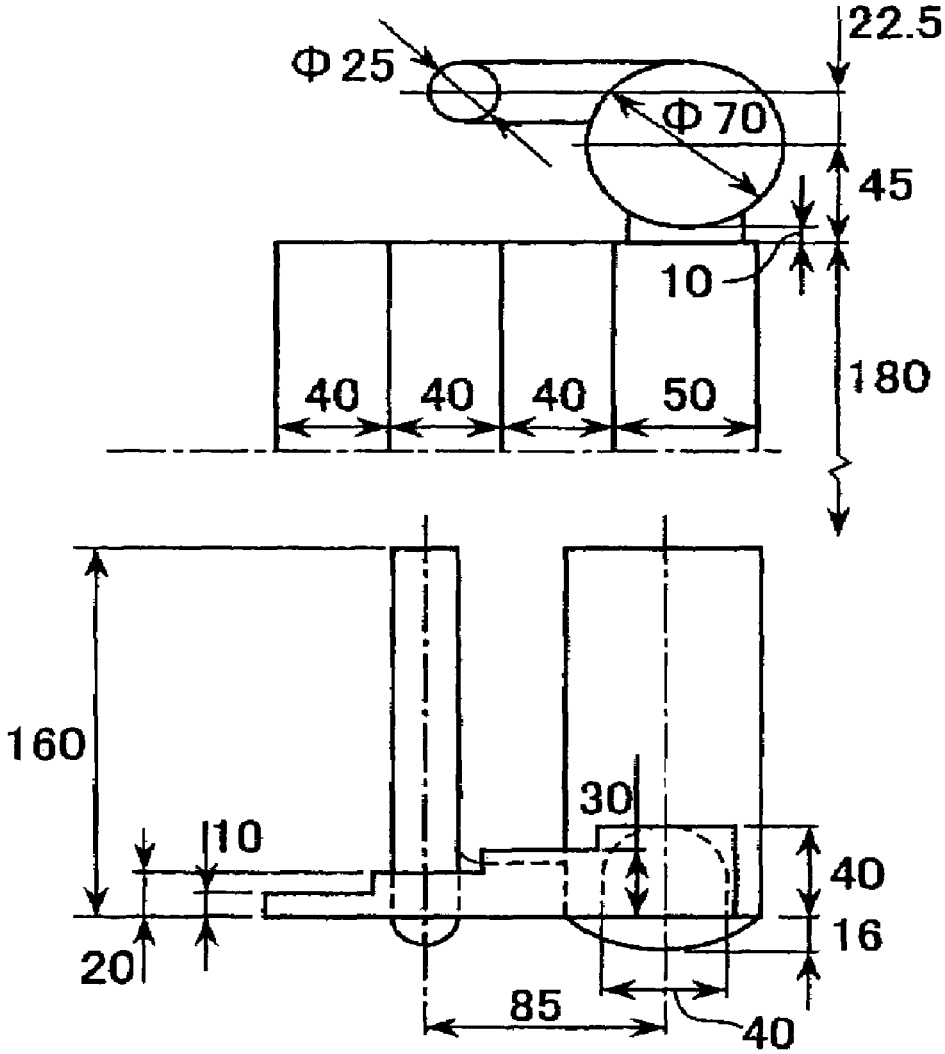
FIG. 1 This is a schematic explanatory diagram illustrating a plan for casting a stepped cast test piece.

One preferred embodiment of the copper-based alloy of this invention and the ingot and liquid-contacting part using the alloy will be described below.

The copper-based alloy of this invention is a copper-based alloy having the soundness of alloy improved during the course of solidification of this alloy by crystallizing an intermetallic compound ZnSe capable of solidifying within the range of temperature exceeding the solidus line of the alloy, more preferably within the range of solidifying temperature as a temperature region between the solidus line and the liquidus line in the dendrite (dendritic crystal) gaps in the alloy, thereby suppressing migration of a solute and effecting dispersion of microporosities (shrinkage cavities) and as well enabling a low melting metal Bi (or a low melting intermetallic compound) capable of solidifying in the temperature region falling short of the liquidus line of the alloy dispersed and crystallized in the solute region in consequence of the suppression of migration, more preferably at a temperature falling short of the solidifying temperature, to enter the microporosities and suppress the occurrence of microporosities.

The adoption of ZnSe as the intermetallic compound or Bi as the low melting metal herein will be explained below. Besides, TiCu (melting point 975° C.), $TiCu_3$ (melting point 885° C.) and $CeBi_2$ (melting point 883° C.) may be cited as concrete examples of the intermetallic compound, and In (melting point 155° C.) and Te (melting point 453° C.) as concrete examples of the low melting metal. InBi (melting point 110° C.) and $In_2Bi$ (melting point 89° C.) can also be cited as concrete examples of the low melting intermetallic compound.

The term "dendrite" as used herein refers to a crystal that is observed when an alloy is solidified. Since it is formed in the shape of branches of a tree, it is called a dendrite. The term "solute" refers to a low melting phase that constitutes a liquid phase within the range of at least a solidifying temperature of an alloy. The term "solidus line" refers to the line that results from connecting the temperatures for completing solidification of a pertinent molten alloy of varying alloy composition and the term "liquidus line" refers to the line that results from connecting the temperatures for starting solidification of a pertinent molten alloy of varying alloy composition.

This copper-based alloy is composed of at least 5.0 to 10.0 weight % of Zn, 2.8 to 5.0 weight % of Sn, 0.25 to 3.0 weight % of Bi, $0<Se\leqq1.5$ weight % of Se, less than 0.5 weight % of P, the balance of Cu and less than 0.2 weight % of Pb as an unavoidable impurity. When this alloy requires having the mechanical property thereof enhanced more effectively, this composition may add 3.0 weight % or less of Ni.

The ranges of the components that form the composition of the copper-based alloy of this invention and the reasons therefor will be explained below.

Zn: 5.0 to 10.0 weight %

This is an effective element for enhancing hardness and mechanical properties including elongation in particular without affecting machinability. Further, since Zn is effective as well in suppressing the formation of Zn oxides due to the absorption of gas into the melt and enhancing the soundness of alloy, the content of Zn of 5.0 weight % or more proves effective in enabling these functions to be manifested. More practically, the content of 7.0 weight % or more proves preferable from the viewpoint of compensating for the suppressions of Bi and Se that will be described herein below. Meanwhile, since Zn has a high vapor pressure, the content of 10:0 weight % or less proves preferable in consideration of the safety of working atmosphere and the castability. When the economy is also taken into consideration, the optimum Zn content is about 8.0 weight %.

Se: $0<Se\leqq 1.5$ weight %

Figure 9:
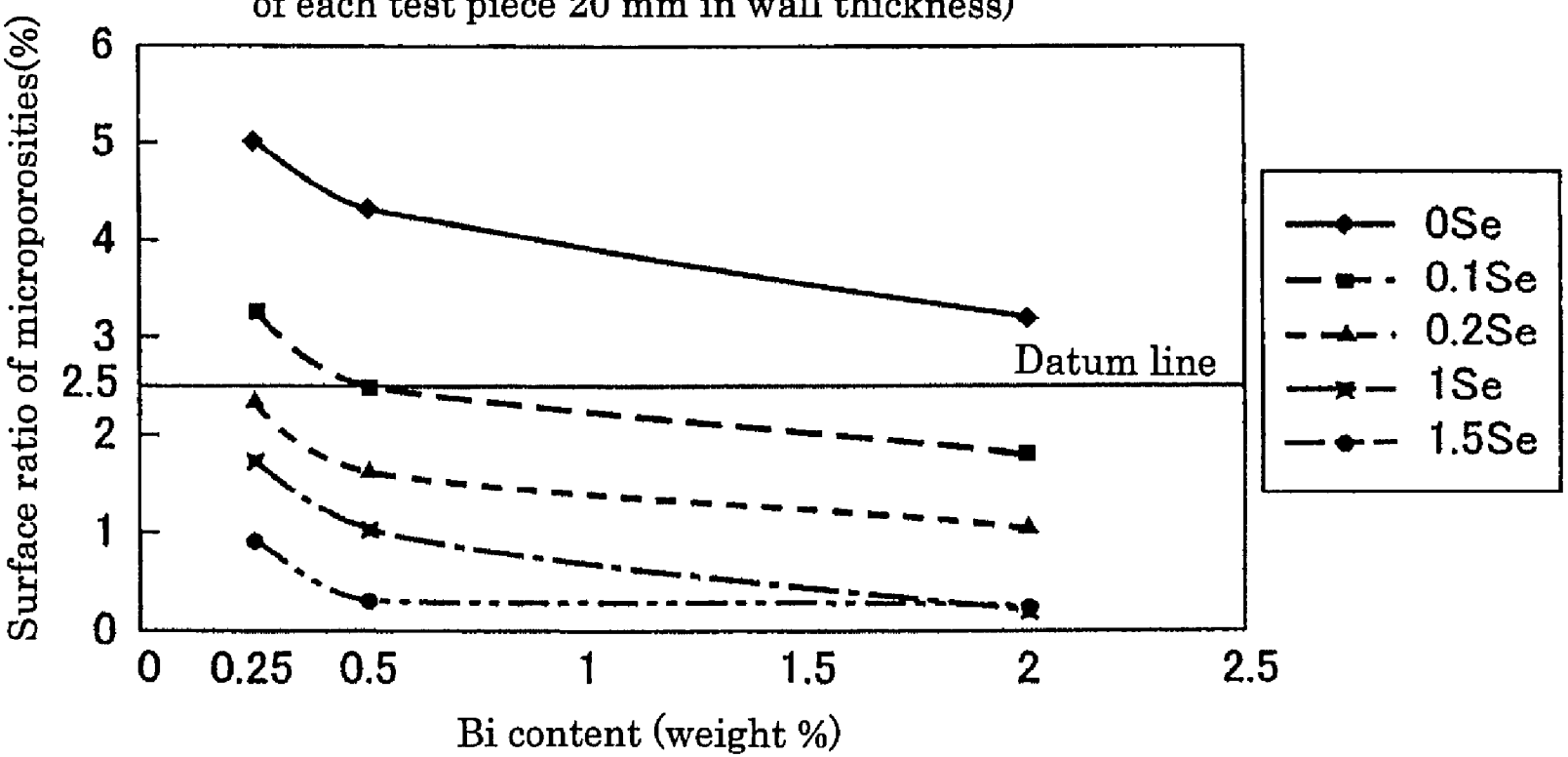
FIG. 9 This is a graph illustrating the relation between the Bi contents and the surface ratios of microporosities at central positions of a test piece 20 mm in wall thickness.

As an alternative component for Pb, this element is enabled by forming an intermetallic compound with the foregoing element Zn to contribute to secure the same machinability as Bi which will be described herein below and enhance the soundness of alloy. Even in a minute content, it forms the intermetallic compound with Zn and contributes to enhance the soundness of alloy. With the object of ensuring these functions and in consideration of the ease of the adjustment of components in the actual process of production, the content of this element of 0.1 weight % or more proves effective. Thus, this value has been set as the proper lower limit. Particularly, for the sake of deriving dispersion of microporosities from crystallization of the intermetallic compound ZnSe without increasing the Bi content and enhancing the soundness of alloy by restricting the surface ratio of microporosities in the central part of alloy below the standard value, the content of this element of about 0.2 weight % proves optimum as shown in FIG. 9 which will be described specifically herein below. Even when the Se content exceeds 1 weight %, the decrease of the surface ratio of the microporosities is in an equilibrated state. Thus, the content of this element of 1.5 weight % has been set as the upper limit. Particularly for the sake of suppressing the Se content and securing the prescribed tensile strength, it is advantageous to set the upper limit at 0.35 weight %.

Bi: 0.25 to 3.0 weight %

As a low melting metal playing the role of an alternative component for Pb, this element Bi is enabled by entering the microporosities occurring in the alloy (casting) during the course of solidification of casting to contribute to enhancement of the soundness of alloy and securement of the machinability. For the sake of decreasing microporosities and securing the pressure resistance of alloy, the content of Bi of 0.25 weight % or more proves effective. Particularly for the sake of suppressing the Se content and acquiring the action of suppressing microporosities that is necessary for the securement of the pressure resistance, the content of Bi of 0.5 weight % proves advantageous as shown in FIG. 9 that will be specifically described herein below. Meanwhile, for the sake of securing the mechanical properties that are found necessary, the content of Bi of 3.0 weight % or less proves effective. Particularly when the efficiency of decreasing microporosities is considered relative to the content of Bi, the content set at 2.0 weight % or less proves advantageous because the decrease of microporosities reaches an equilibrated state in the neighborhood of 2.0 weight %. Incidentally, the temperature of solidification and crystallization of Bi is about 271° C.

Sn: 2.8 to 5.0 weight %

This element is contained with a view to enhancing abrasion resistance and corrosion resistance by taking advantage of its capability of inducing solid solution in the α-phase, enhancing strength and hardness and forming a protective film of $SnO_2$; The element Sn deteriorates machinability linearly in proportion as the content thereof is increased within the practical range of use. The range of content mentioned above has been fixed with a view to securing mechanical properties within the purview of suppressing the content and avoiding deterioration of corrosion resistance as well. As a more preferable range which directs attention to the characteristic of elongation liable to be influenced by the Sn content and enjoys acquisition of elongation in the neighborhood of the approximately highest value in spite of changes in the casting conditions, the content of 3.5 to 4.5 weight % proves optimum.

Ni: 3.0 weight % or less

This element is added when it is required that the mechanical properties of alloy are enhanced more effectively. This element Ni permits solid solution in the α-phase, fortifies the matrix and enhance the mechanical properties of alloy to a certain extent. The limit mentioned above has been fixed in consideration of the fact that an excess of this content results in suffering this element to form an intermetallic compound with Cu and Sn, thereby enhancing the machinability and meanwhile deteriorating the mechanical properties. Though the content of 0.2 weight % or more proves effective in enhancing the mechanical strength, the peak of the mechanical strength exists in the neighborhood of 0.6 weight %. Thus, in consideration of changes in the casting conditions, the ideal Ni content has been fixed in the range of 0.2 to 0.75 weight %.

P: less than 0.5 weight %

This element is added in an amount of less than 0.5 weight % with a view to promoting deoxidation of the molten copper alloy and allowing manufacture of a sound casting and a continuous ingot. An excess of this content tends to lower the solidus line and induce segregation, gives rise to a P compound and embrittles the casting. The range of 200 to 300 ppm proves preferable in the case of mold casting and the range of 0.1 to 0.2 weight % proves preferably in the case of continuous casting.

Pb: less than 0.2 weight %

The limit of less than 0.2 weight % has been fixed for the element Pb as an unavoidable impurity that is not positively contained.

The ingot produced by using the copper-based alloy mentioned above is provided as an intermediate product or as a liquid-contacting part resulting from machining the alloy. The liquid-contacting parts included, for example, valve parts including valves, stems, valve seats and disks for potable water, plumbing materials including faucets and joints, devices for service and drain pipes, devices including strainers, pumps and motors which are fated to contact liquids, liquid-contacting faucet fittings, hot water-handling devices including hot feed water devices, parts and members for clean water lines, and intermediates including coils and hollow bars other than the finished products and assembled bodies enumerated above.

Example 1

Figure 2:
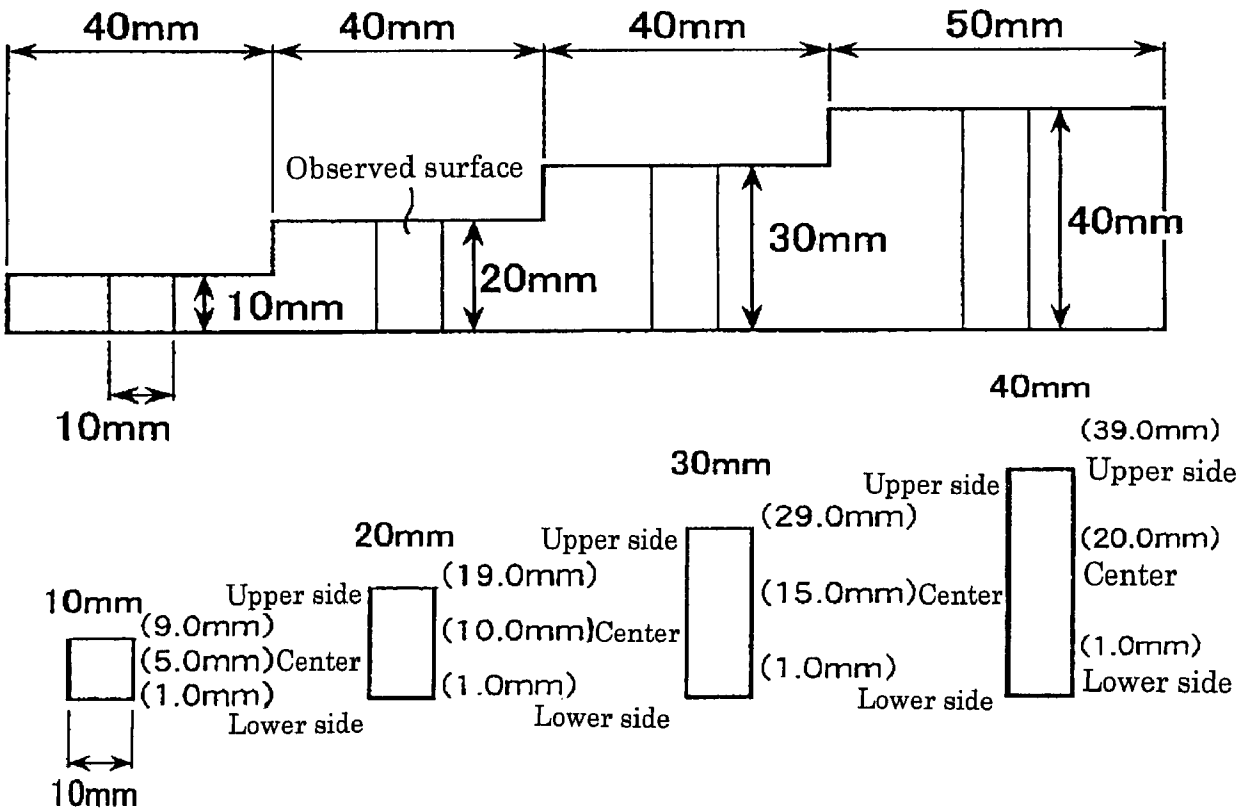
FIG. 2 This is an explanatory diagram illustrating measured portions on each test piece.

The copper-based alloy according to this invention was tested for alloy soundness. The results of this test will be explained below. FIG. 1 is an explanatory diagram illustrating a plan for casting a stepped cast test piece and FIG. 2 is an explanatory diagram illustrating measured portions on each test piece.

The samples (Bi-based leadless bronze alloys), No. 1 to No. 15 shown in Table 1 below, were cast in accordance with the plan for casting a stepped cast test piece illustrated in FIG. 1. The test pieces of a configuration shown in FIG. 2 were cut from the resultant castings. The cut surfaces of the individual test pieces were ground and then tested for surface ratios of ZnSe (intermetallic compound, Bi (low melting metal) and microporosities. The surface ratio was determined by using a zone enlarged to 200 magnifications by the image analyzing software as a visual range and measuring the relevant surface ratios found in this visual range. At the same measured position, the determination was given to a total of ten (n=10) while slightly shifting the visual fields, and the average of the ten resultant values thus obtained was reported as the surface ratio at the position in Table 2 below. The plan for casting the stepped cast test piece comprised casting a pertinent molten metal from the lateral side of the wall thickness of 40 mm in the stepped part through a feeder head of 70 mm in diameter and 160 mm in height from the sprue gate 25 mm in diameter. As regards the casting conditions, the melting was effected in a 15-kg high-frequency experimental furnace, the amount of melting was 13.5 kg, the casting temperature was 1180° C., the casting time was 7 seconds, the cast molding was a $CO_2$ mold, and the deoxidation treatment was due to the addition of P of 250 ppm.

TABLE 1

| | Chemical Components (weight %) | | | | | | |
|---|---|---|---|---|---|---|---|
| No. | Cu | Zn | Sn | Bi | Se | Pb | P (ppm) |
| 1 | Balance | 8.01 | 3.61 | 1.99 | 0.00 | 0.03 | 201 |
| 2 | Balance | 7.98 | 3.57 | 2.02 | 0.11 | 0.03 | 221 |
| 3 | Balance | 7.89 | 3.54 | 2.03 | 0.20 | 0.02 | 206 |
| 4 | Balance | 7.92 | 3.58 | 2.01 | 1.08 | 0.04 | 203 |
| 5 | Balance | 7.88 | 3.60 | 2.04 | 1.52 | 0.03 | 243 |
| 6 | Balance | 8.09 | 3.61 | 0.52 | 0.00 | 0.04 | 233 |
| 7 | Balance | 8.03 | 3.59 | 0.51 | 0.09 | 0.05 | 230 |
| 8 | Balance | 7.88 | 3.49 | 0.48 | 0.19 | 0.01 | 244 |
| 9 | Balance | 7.91 | 3.55 | 0.50 | 1.01 | 0.03 | 216 |
| 10 | Balance | 8.03 | 3.57 | 0.53 | 1.53 | 0.02 | 205 |
| 11 | Balance | 8.00 | 3.57 | 0.25 | 0.00 | 0.02 | 214 |
| 12 | Balance | 8.03 | 3.55 | 0.24 | 0.12 | 0.04 | 222 |
| 13 | Balance | 8.03 | 3.44 | 0.25 | 0.22 | 0.03 | 241 |
| 14 | Balance | 7.96 | 3.52 | 0.25 | 1.03 | 0.05 | 204 |
| 15 | Balance | 7.92 | 3.53 | 0.27 | 1.49 | 0.02 | 208 |

TABLE 2

| | | | Measured Position | | | | | | | | |
|---|---|---|---|---|---|---|---|---|---|---|---|
| | | | Surface ratio of Bi (n = 10) | | | Surface ratio of ZnSe (n = 10) | | | Surface ratio of microporosities (n = 10) | | |
| No. | Test Level | Wall Thickness of Casting | 1 mm from bottom | Center | 1 mm from top | 1 mm from bottom | Center | 1 mm from top | 1 mm from bottom | Center | 1 mm from top |
| 1 | 2% Bi-0% Se | 10 | | 1.90 | | | | | | 3.85 | |
| | | 20 | 3.01 | 1.56 | 3.30 | | | | 0.03 | 3.21 | 0.05 |
| | | 30 | | 1.75 | | | | | | 4.62 | |
| | | 40 | | 1.76 | | | | | | 0.77 | |
| 2 | 2% Bi-0.1% Se | 10 | | 1.74 | | | 0.34 | | | 1.84 | |
| | | 20 | 2.49 | 1.69 | 2.45 | 0.36 | 0.35 | 0.35 | 0.02 | 1.85 | 0.01 |
| | | 30 | | 1.69 | | | 0.36 | | | 2.67 | |
| | | 40 | | 1.73 | | | 0.37 | | | 0.75 | |
| 3 | 2% Bi-0.2% Se | 10 | | 1.74 | | | 0.78 | | | 0.91 | |
| | | 20 | 2.34 | 1.81 | 2.25 | 0.61 | 0.55 | 0.59 | 0.01 | 1.08 | 0.03 |
| | | 30 | | 1.82 | | | 0.79 | | | 2.11 | |
| | | 40 | | 1.80 | | | 0.76 | | | 0.56 | |
| 4 | 2% Bi-1% Se | 10 | | 1.76 | | | 3.3 | | | 0.45 | |
| | | 20 | 2.04 | 1.76 | 1.99 | 3.52 | 3.5 | 3.48 | 0.02 | 0.20 | 0.03 |
| | | 30 | | 1.77 | | | 3.39 | | | 1.89 | |
| | | 40 | | 1.70 | | | 3.4 | | | 0.10 | |
| 5 | 2% Bi-1.5% Se | 10 | | 1.80 | | | 4.90 | | | 0.39 | |
| | | 20 | 1.94 | 1.78 | 1.88 | 5.04 | 4.92 | 5.00 | 0.03 | 0.24 | 0.01 |
| | | 30 | | 1.78 | | | 4.94 | | | 1.49 | |
| | | 40 | | 1.87 | | | 5.12 | | | 0.14 | |
| 6 | 0.5% Bi-0% Se | 20 | 1.25 | 0.64 | 1.11 | | | | 0.02 | 4.31 | 0.06 |
| 7 | 0.5% Bi-0.1% Se | 20 | 0.90 | 0.59 | 0.82 | 0.39 | 0.37 | 0.36 | 0.07 | 2.48 | 0.04 |
| 8 | 0.5% Bi-0.2% Se | 20 | 0.61 | 0.51 | 0.68 | 0.69 | 0.72 | 0.70 | 0.08 | 1.66 | 0.01 |
| 9 | 0.5% Bi-1% Se | 20 | 0.52 | 0.51 | 0.54 | 3.55 | 3.47 | 3.50 | 0.03 | 1.04 | 0.09 |
| 10 | 0.5% Bi-1.5% Se | 20 | 0.49 | 0.49 | 0.52 | 5.12 | 5.14 | 5.07 | 0.04 | 0.29 | 0.04 |
| 11 | 0.25% Bi-0% Se | 20 | 0.38 | 0.24 | 0.44 | | | | 0.03 | 5.04 | 0.02 |
| 12 | 0.25% Bi-0.1% Se | 20 | 0.29 | 0.24 | 0.27 | 0.39 | 0.34 | 0.42 | 0.01 | 3.26 | 0.04 |
| 13 | 0.25% Bi-0.2% Se | 20 | 0.24 | 0.22 | 0.25 | 0.70 | 0.59 | 0.81 | 0.03 | 2.33 | 0.09 |
| 14 | 0.25% Bi-1% Se | 20 | 0.21 | 0.23 | 0.25 | 3.81 | 3.22 | 3.90 | 0.02 | 1.71 | 0.02 |
| 15 | 0.25% Bi-1.5% Se | 20 | 0.23 | 0.24 | 0.24 | 4.94 | 5.11 | 5.07 | 0.01 | 0.89 | 0.03 |

For the purpose of specifying in advance the surface ratio of microporosities destined to constitute the standard for judging the soundness of alloy, stepped test pieces 20 mm in wall thickness were subjected to a visible dye penetrant testing. The visible dye penetrant testing consists in spraying a penetrant onto the cut surface of a test piece, allowing the applied layer of the penetrant to stand at rest for 10 minutes, then wiping the penetrant off the cut surface, further spraying a developer onto the cut surface, and judging the existence of a casting defect depending on the display of a red color consequently standing out on the cut surface. The results of this visible dye penetrant testing, the Bi and Se contents and the surface ratios of microporosities manifested by the samples used in the visible dye penetrant testing are shown in Table 3 below. Incidentally, in the individual samples, the content of Zn was about 8 weight %, that of Sn about 3.6 weight %, that of Pb about 0.03 weight % and that of P about 220 ppm. As shown in Table 3 below, the samples revealing very small defects and posing no problem about pressure resistance are designated by the mark of a balloon O, the samples revealing some defects and the valves manufactured therefrom satisfying the pressure resistance specified by the JIS (Japanese Industrial Standard) are designated by the mark of a triangle Δ), and the samples revealing defects copiously are designated by the mark of a cross X. As a result, it has been confirmed that the samples reveal very few defects of alloy and satisfy a prescribed capacity of pressure resistance when their surface ratios of microporosities are 2.53% or less and more safely about 2.5% or less.

TABLE 3

| Result of penetrant testing | Bi content (weight %) | Se content (weight %) | Surface ratio of microporocities (%) |
|---|---|---|---|
| X | 0.25 | 0.0 | 5.04 |
| X | 0.52 | 0.0 | 3.89 |
| X | 1.99 | 0.0 | 3.21 |
| X | 0.24 | 0.12 | 3.26 |
| Δ | 0.51 | 0.09 | 2.09 |
| ○ | 2.02 | 0.11 | 1.85 |
| Δ | 0.25 | 0.22 | 2.33 |
| ○ | 0.48 | 0.19 | 1.34 |
| ○ | 2.03 | 0.20 | 1.08 |
| Δ | 0.42 | 0.09 | 2.53 |

Now, the function of the intermetallic compound ZnSe that solidifies within the range of solidifying temperature, namely the temperature range exceeding the solidus line of a copper-based alloy and more preferably the temperature range between the solidus line and the liquidus line, will be explained below.

Figure 3:
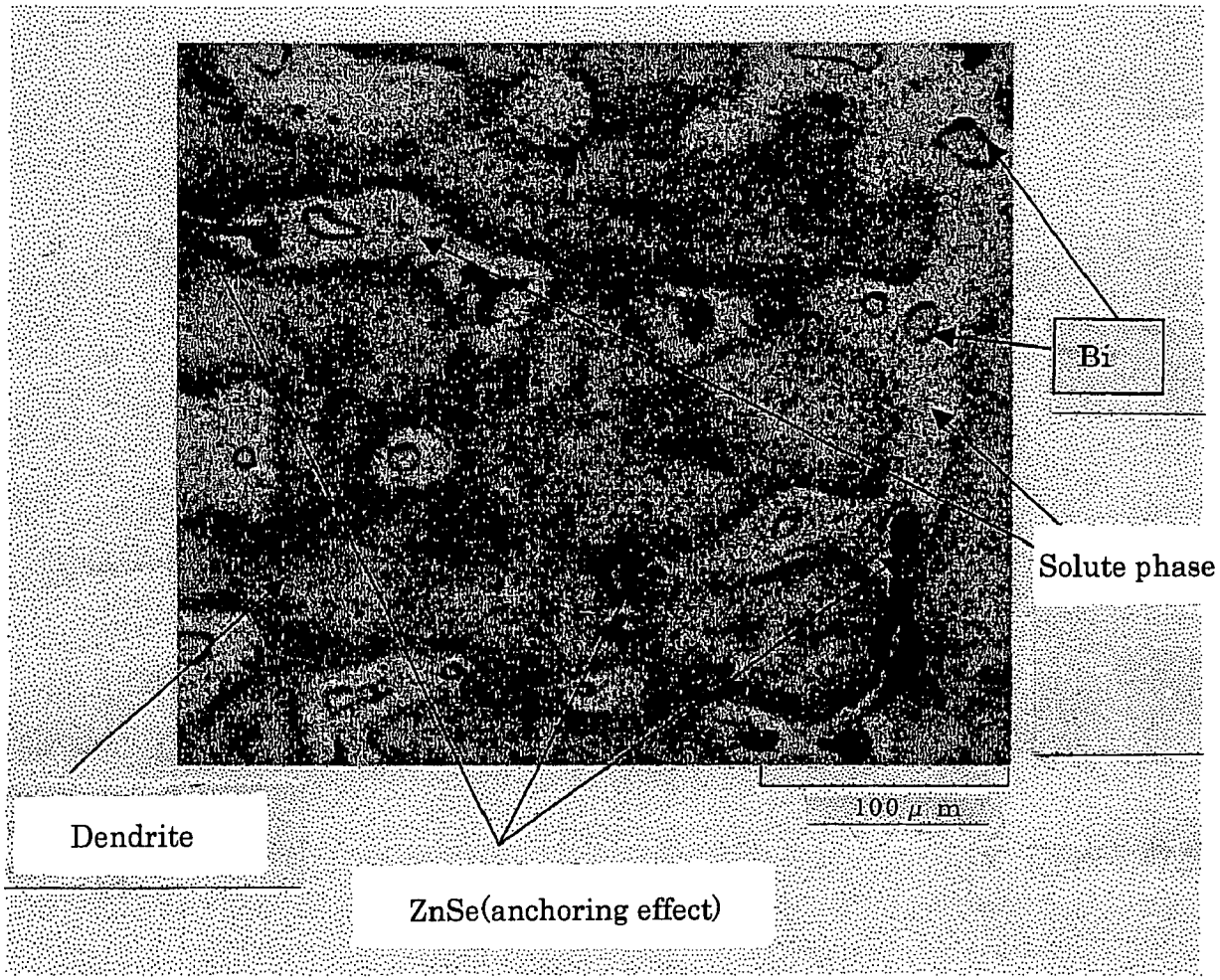
FIG. 3 This is a metallographic picture of a copper-based alloy according to this invention.

FIG. 3 is the metallographic picture of a sample, No. 4 (2% Bi-1% Se). The intermetallic compound ZnSe (the melting point about 880° C.) which solidifies within the range of solidifying temperature (about 982 to 798° C.) of the copper-based alloy forming this sample exists metallographically either independently or adjacently to Bi in the solute phase (low melting phase) intervening in a plurality of dendritic gaps formed mainly of Cu. That is, it has been ascertained that the intermetallic compound ZnSe that solidifies within the range of solidifying temperature of the copper-based alloy is enabled, by being captured in the dendritic gaps crystallized within the aforementioned range of solidifying temperature and prevented from producing a free movement, to be substantially uniformly dispersed and crystallized and inhibited from segregation. Incidentally, the solidification of the intermetallic compound within the range of solidifying temperature is preferred because the intermetallic compound is solidified after the solidification has advanced to a certain extent and the dentrite has been crystallized, and the intermetallic compound is consequently captured infallibly in the dendritic gaps. This fact will be verified on the basis of the test results shown in Table 2 above.

Figure 4:
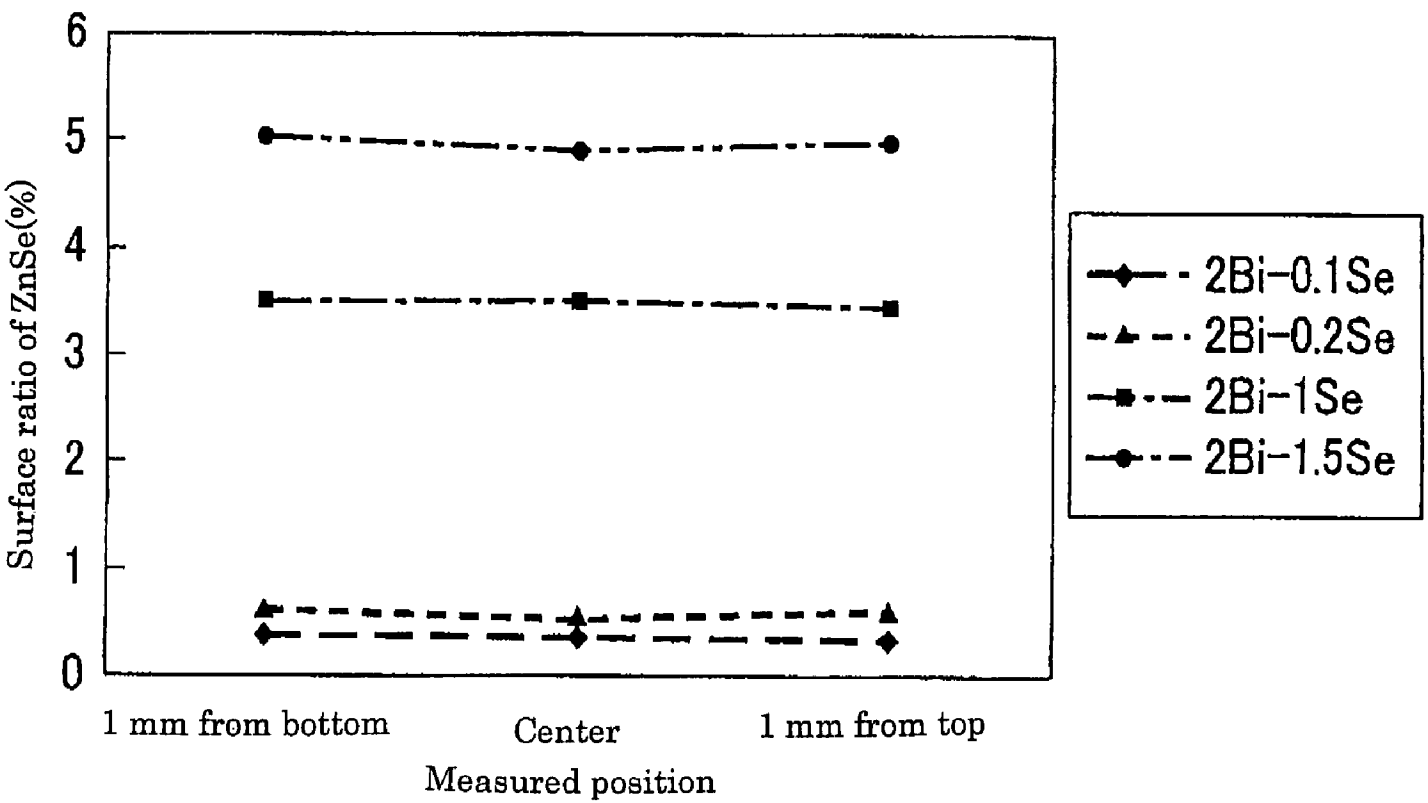
FIG. 4 This is a graph illustrating surface ratios of ZnSe at varying measured portions of a test piece 20 mm in wall thickness.
Figure 5:
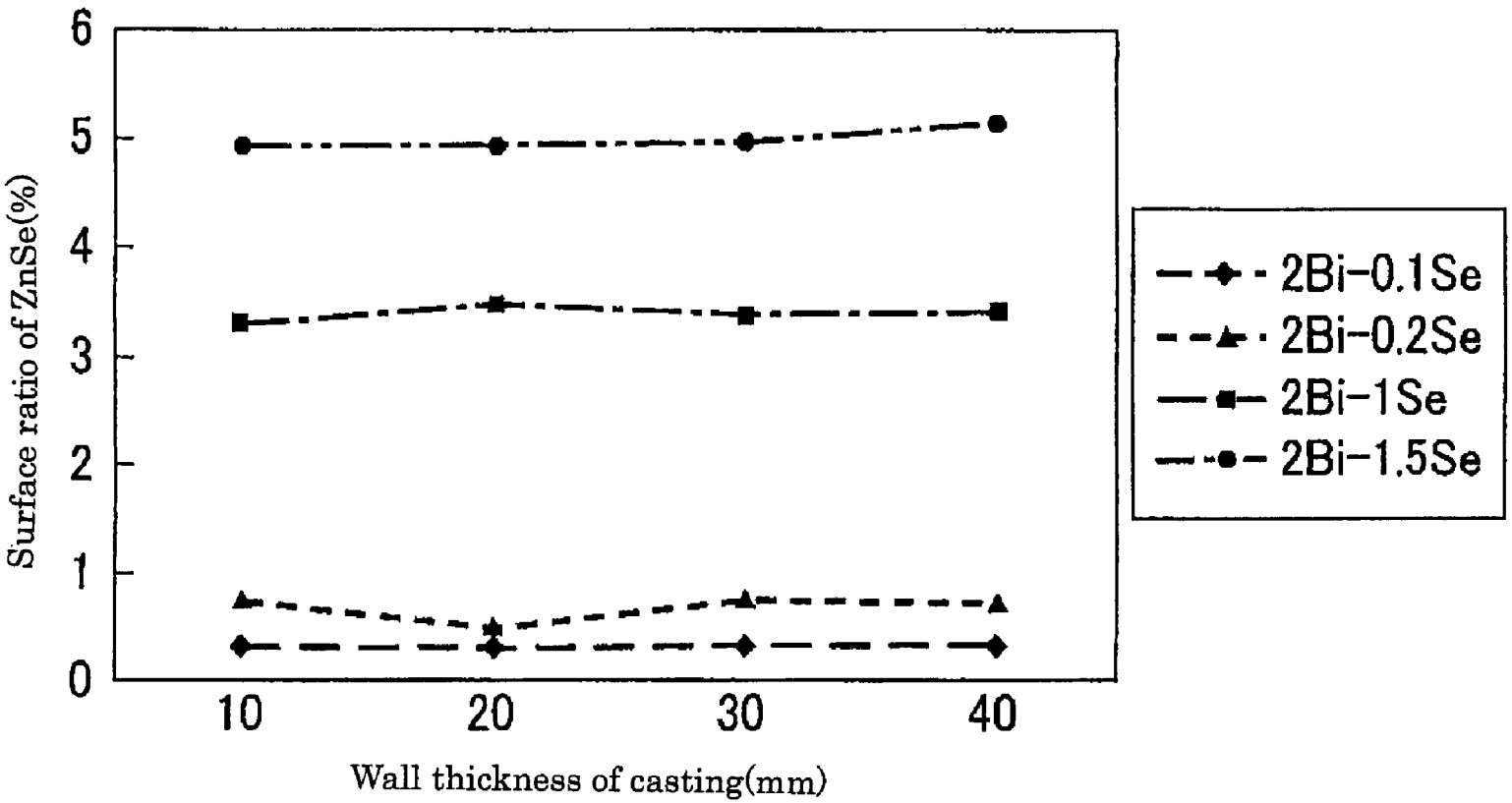
FIG. 5 This is a graph illustrating surface ratios of ZnSe at central positions of each test piece.

The surface ratios of ZnSe determined of the samples, No. 2 (2% Bi-0.1% Se), No. 3 (2% Bi-0.2% Se), No. 4 (2% Bi-1% Se) and No. 5 (2% Bi-1.5% Se) at a prescribed measured position of a test piece of casting 20 mm in wall thickness are shown in FIG. 4. As shown in FIG. 2, the surface ratios of ZnSe found at the measured positions, 1 mm from the bottom, the center and 1 mm from the top, show virtually no difference. It has been ascertained even in terms of numerical values that the intermetallic compound capable of solidifying within the range of solidifying temperature of the copper-based alloy is substantially uniformly dispersed in the alloy. This dispersion equals in spite of a difference in the wall thickness of casting. As shown by the graph of FIG. 5, the same samples as those of the graph of FIG. 4 that have different wall thicknesses of 10 mm, 20 mm, 30 mm and 40 mm reveal virtually no difference of the surface ratio of ZnSe at the measured position of center of each sample.

Even in the alloys which have comparatively high Zn—Sn contents, such as 15Zn-12Sn-2Bi-0.4Se (the liquidus line about 868° C. and the solidus line about 670° C.) and 20Zn-8Sn-2Bi-0.2Se (the liquidus line about 870° C. and the solidus line about 702° C.), namely the alloys which have liquidus line temperatures lower than the crystallizing temperature of ZnSe, the intermetallic compound ZnSe exists in the dendritic gaps. The TiCu (the melting point 975° C.) mentioned above and other intermetallic compounds answer this description.

It is because ZnSe is seized in the flow path of the solute phase (the low melting phase) in the dendritic gaps and consequently enabled to manifest the anchoring effect of blocking this flow path so that the solute phase (the low melting phase) is prevented from producing a free movement and, as a result, the microporosities are dispersed in the alloy without concentrically occurring in the central part of the wall thickness. This fact will be verified on the basis of the test results shown in Table 2 above.

Figure 6:
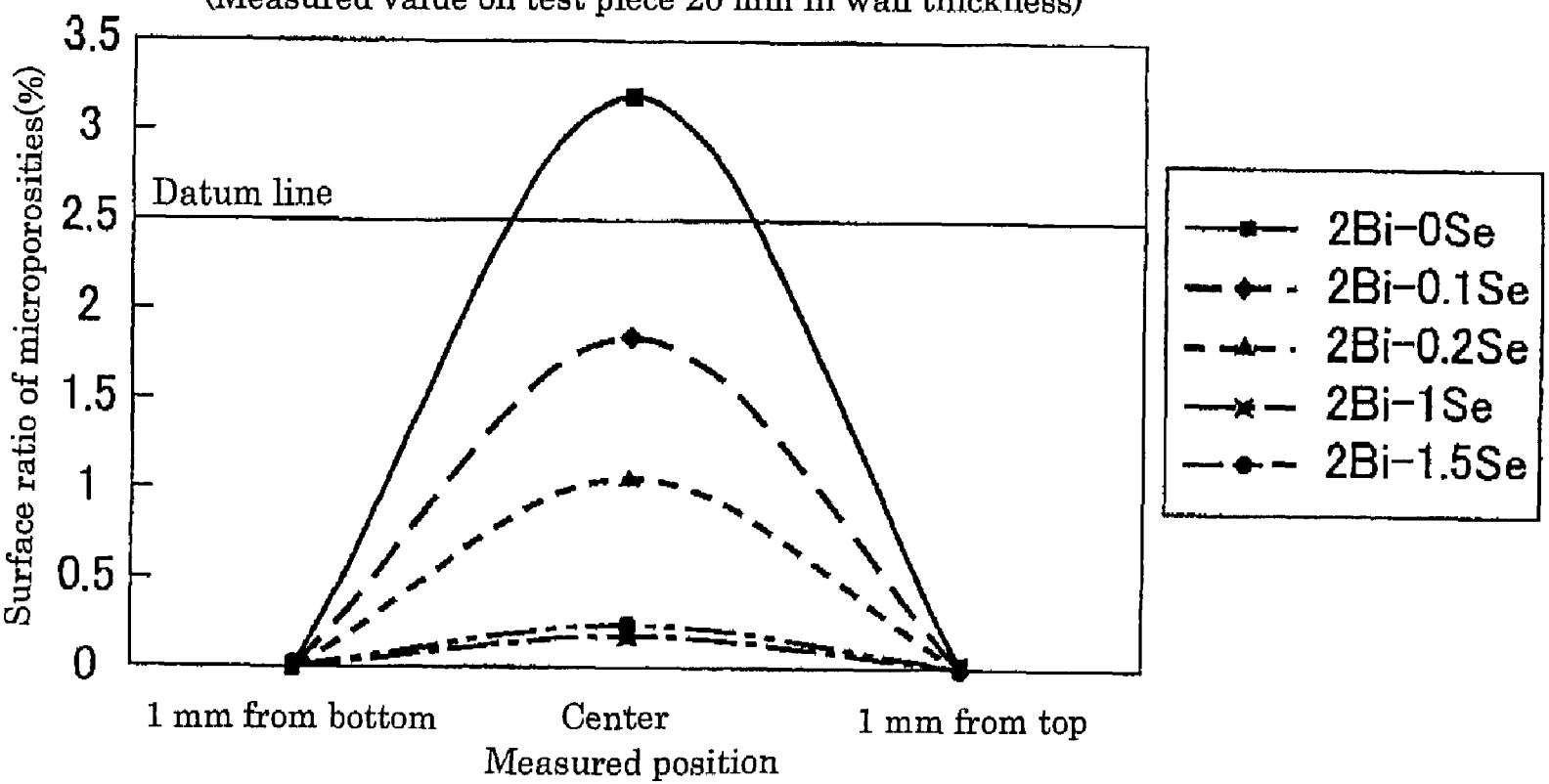
FIG. 6 This is a graph illustrating surface ratios of microporosities at varying measured portions of a test piece 20 mm in wall thickness.

The surface ratios of microporosities determined of the samples, No. 1 (2% Bi-0% Se), No. 2 (2% Bi-0.1% Se), No. 3 (2% Bi-0.2% Se), No. 4 (2% Bi-1% Se) and No. 5 (2% Bi-1.5% Se) at a prescribed measured position of a test piece of casting 20 mm in wall thickness are shown in FIG. 6. In the sample No. 1 which contains absolutely no Se, the surface ratio of microporosities at the center is very high as compared with the surface ratios at 1 mm from the bottom and 1 mm from the top and moreover surpasses the standard 2.5% for the judgment of the pressure resistance of alloy. When the Se content is increased to 0.1% and 0.2% and so on, the microporosites at the centers of samples decrease proportionately. Particularly only by causing Se to be contained in such a small ratio as 0.1 weight %, it is made possible to decrease the surface ratio of microporosities at the measured position of center of a sample to below 2.5% which is the standard for judgment of the pressure resistance. Thus, it has been ascertained even in terms of numerical value that by causing the intermetallic compound capable of solidifying within the range of solidifying temperature of the copper-based alloy to be crystallized in the dendritic gaps of alloy and consequently suppressing the movement of the solute, it is made possible to disperse microporosities, suppress the occurrence of microporosities in the central part of wall thickness of the alloy and enhance the soundness of alloy.

Figure 7:
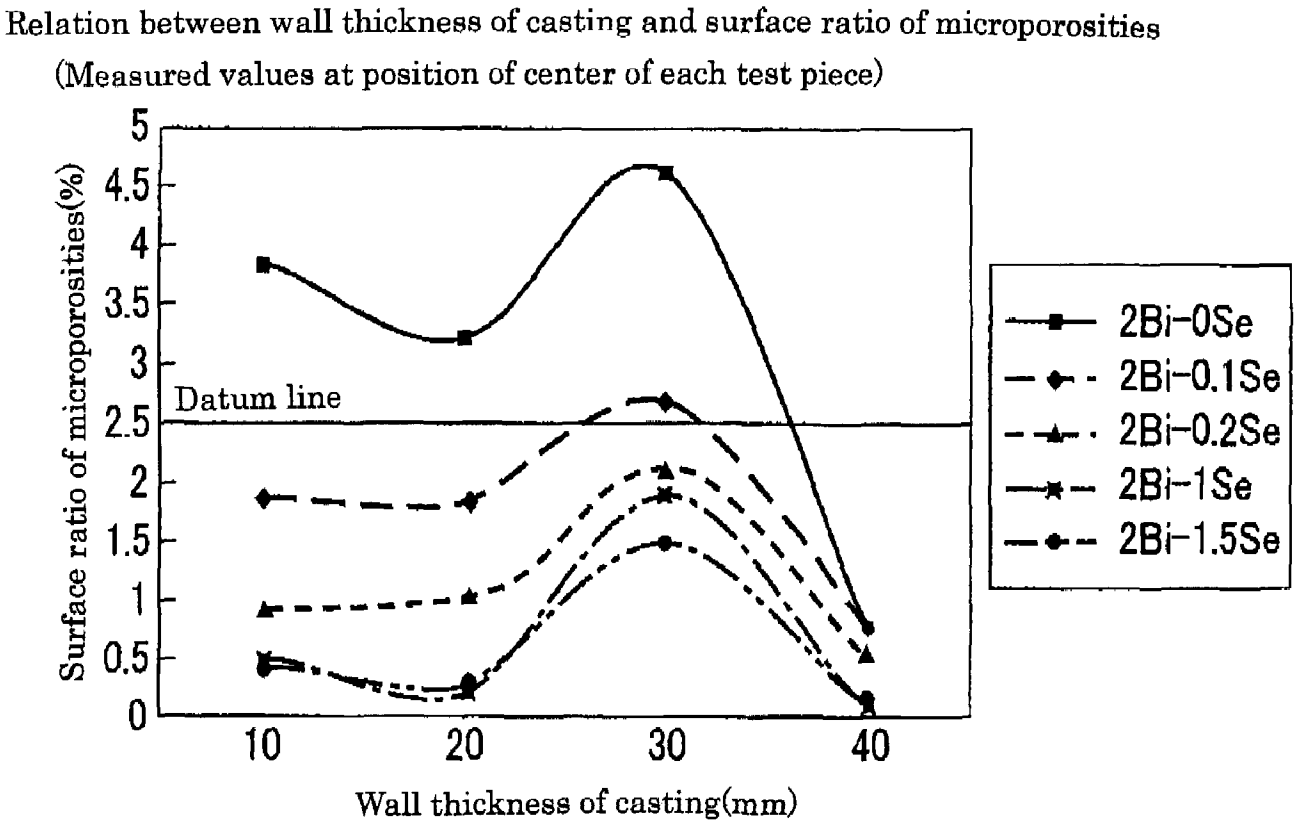
FIG. 7 This is a graph illustrating surface ratios of microporosities at central positions of each test piece.

This dispersion equals in spite of a difference in the wall thickness of casting. As shown by the graph of FIG. 7, the same samples as those of the graph of FIG. 6 which have different wall thicknesses of 10 mm, 20 mm, 30 mm and 40 mm are enabled to decrease microporosities at the center of a sample to below 2.5%, the standard for judgment of the pressure resistance proportionately as the Se content is increased to 0.1%, 0.2% and so on. Incidentally, the samples 30 mm in wall thickness have high surface ratios of microporosities because the plan for testing allows the portions of this wall thickness to generate microporosites most easily. In the actual manufacture of the alloy, by adjusting the plan for casting together with the Se content, it is made possible to lower the occurrence of microporosites to below the standard for judgment of the pressure resistance.

The foregoing test results justify the conclusion that when the surface ratio of the intermetallic compound capable of solidifying within the range of solidifying temperature of the copper-based alloy is 0.3% or more and 5.0% or less, it proves effective on the basis of the data of Table 2 above and in consideration of the differences in the actual conditions of casting.

Now, the function of the low melting metal Bi which solidifies in the range of temperature of less than the liquidus line of the copper-based alloy, and more preferably at the temperature of less than the solidifying temperature will be explained below.

It is because the ZnSe is seized in the flow path of the solute phase (the low melting phase) in the dendritic gaps and consequently enabled to manifest the anchoring effect of blocking the flow path so that the solute phase (the low melting phase) is prevented from producing a free movement and, as a result, the low melting metal Bi which is capable of solidifying and crystallizing in the solute region at a temperature of less than the solidifying temperature of the copper-based alloy is inhibited from segregating on the alloy surface and dispersed in the alloy. The solidification of the low melting metal at the temperature of less than the solidifying temperature is preferred because the low melting metal is solidified after the solute is prevented from producing a free movement by the seizure of the ZnSe in the dendritic gaps and the low melting metal is consequently dispersed infallibly. This fact will be verified on the basis of the test results of Table 2 above.

Figure 8:
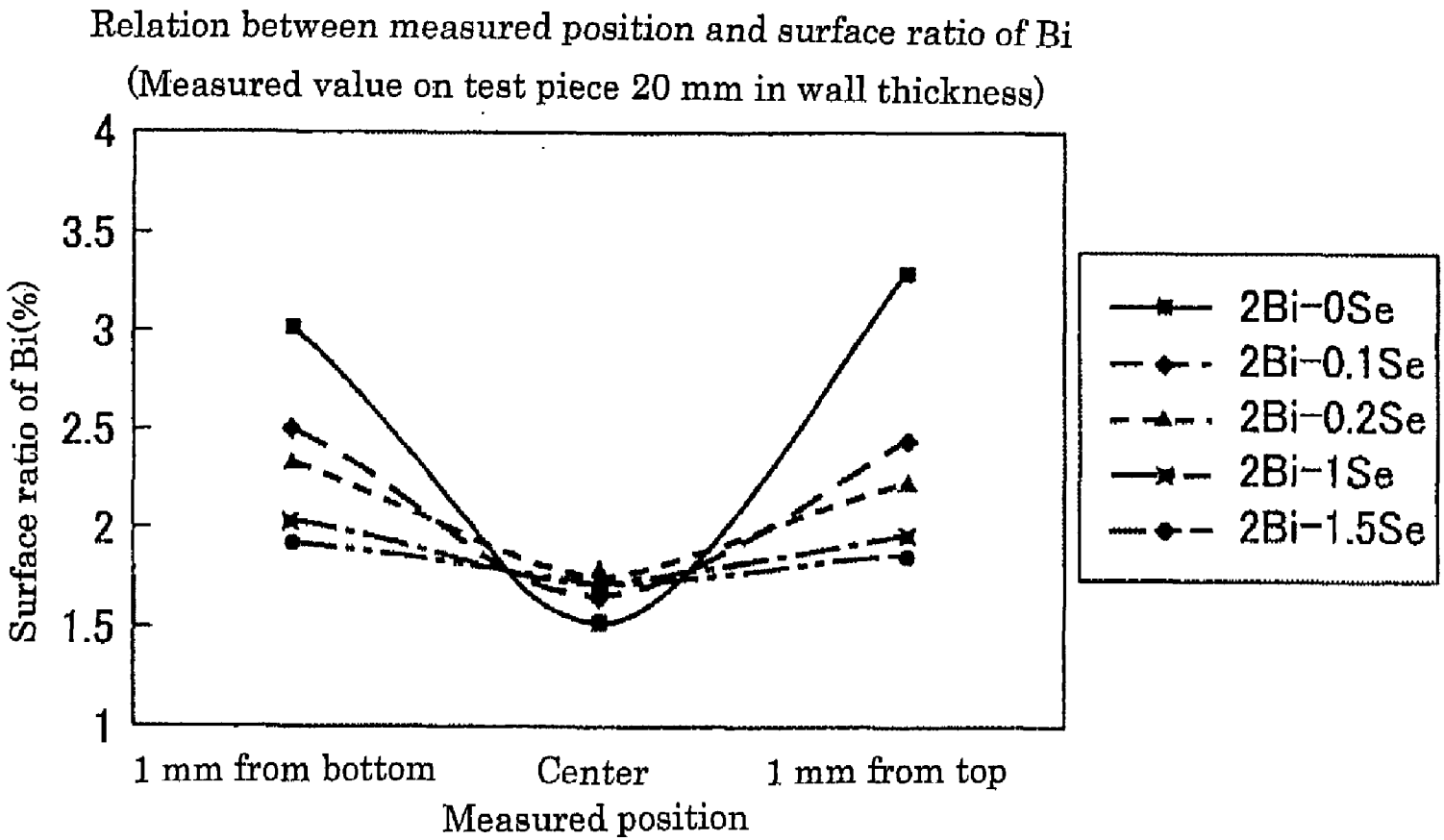
FIG. 8 This is a graph illustrating surface ratios of Bi at varying measured portions of a test piece 20 mm in wall thickness.

The surface ratios of Bi determined of the samples, No. 1 (2% Bi-0% Se), No. 2 (2% Bi-0.1% Se), No. 3 (2% Bi-0.2% Se), No. 4 (2% Bi-1% Se) and No. 5 (2% Bi-1.5% Se) at a prescribed measured position of a test piece of casting 20 mm in wall thickness are shown in FIG. 8. In the sample No. 1 which contains absolutely no Se, the surface ratios of Bi at the position of 1 mm from the bottom and the position of 1 mm from the top are very high as compared with the surface ratio at the position of center, indicating that the alloy surface is segregated. The surface ratios of Bi on the surfaces, of sample decrease and the differences of surface ratio from those at the positions of center decrease in proportion as the Se content increases to 0.1%, 0.2% and so on. Particularly only by causing Se to be contained in such a small ratio as 0.1 weight %, it is made possible to decrease the surface ratio of Bi on the alloy surface by about 30% at the measured position of 1 mm from the top.

Thus, it has been ascertained even in terms of numerical values that, by causing the intermetallic compound capable of solidifying within the range of solidifying temperature of the copper-based alloy to be crystallized in the dendritic gaps of alloy and to suppress the movement of the solute, it is made possible to have the low melting metal capable of solidifying at a temperature lower than the aforementioned solidifying temperature dispersed and crystallized in the region of the solute mentioned above and enabled to suppress the segregation on the alloy surface. Incidentally, the fact that the ZnSe is seized in the flow path of the solute phase (the low melting phase) in the dendritic gaps and consequently enabled to suppress the free movement of the solute phase can be confirmed by the metallographic picture of FIG. 3 which does not show the Sn-rich solute phase appreciably in the periphery of the region in which ZnSe is present independently. More specifically, this confirmation can be made in the light of the fact the Sn-rich solute phase is present in a comparatively small amount in the periphery of the single ZnSe crystals notwithstanding it is present in the periphery of Bi so as to encircle Bi.

The fact that the low melting metal Bi mentioned above enters the microporosities and suppresses the occurrence of microporosities will be verified on the basis of the test results of Table 2 above.

The surface ratios of microporosites determined of the samples, No. 1 to No. 15, at a prescribed measured position of a test piece of casting 20 mm in wall thickness are shown in the graph of FIG. 9. In the sample No. 1 which contains absolutely no Se, the surface ratios of microporosites are unduly high and are not enabled by increasing the Bi content to fall below 2.5% that constitutes the standard for judging the pressure resistance. The microporosities are decreased in proportion as the Se content is increased to 0.1%, 0.2% and so on. Particularly only by causing Se to be, contained in such a small ratio as 0.1 weight %, it is made possible to decrease the surface ratio of microporosities at the measured position of center of a sample. In the sample No. 7 (0.5Bi-0.1% Se), this decrease from the sample No. 6 (0.5Bi-0% Se) having a Bi content of 0.5 weight % totals a little over about 40%.

Thus, it has been ascertained even in terms of numerical values that it is enabled to suppress the movement of the solute and effect the dispersion of microporisities by causing the intermetallic compound capable of solidifying within the temperature range surpassing the solidus line of the copper-based alloy, preferably within the range of solidifying temperature, to be crystallized in the dendritic gaps of the alloy and further that it is made possible to decrease the microporosities effectively and enhance the soundness of alloy by causing the low melting metal capable of solidifying in the temperature range falling short of the liquidus line of the alloy, preferably at the temperature lower than the solidifying temperature to be dispersed and allowed to enter the microporosities.

The foregoing test results justify the conclusion that when the surface ratio of the low melting metal capable of solidifying at a temperature lower than the solidifying temperature of the copper-based alloy is 0.2% or more and 2.5% or less, it proves effective on the basis of the data of Table 2 above and in consideration of the differences in the actual conditions of casting.

Example 2

The samples shown in Table 2 above are subjected to a tensile test and a test for machinability.

The tensile test is performed with an Amsler tester using a test piece of JIS (Japanese Industrial Standard) No. 4 ($CO_2$ casting mold) at a casting temperature of 1130° C. All the test pieces are confirmed to have tensile strengths exceeding 195 $N/mm^2$ that is the standard for CAC406. The elongations of the test pieces exceed 20%. Thus, it is ascertained that the alloys according to this example acquire a prescribed tensile strength, enjoy an enhanced soundness of alloy and manifest a prescribed pressure resistance.

The test for machinability is performed on the samples, No. 1 to No. 5, No. 10 and No. 15, by using the test pieces obtained by machining cylindrical workpieces with an engine lathe, measuring the cutting resistances exerted on the cutting tool, and rating the found cutting resistances on the basis of the cutting resistance of the bronze casting CAC406 taken as 100.

The test is carried out without using an oil under such conditions as a casting temperature of 1180° C. (the $CO_2$ casting mold), a workpiece shape of 31 mm in diameter and 260 mm in height, a surface roughness RA of 3.2, a cutting depth of 3.0 mm on one side of wall thickness, a rotational frequency of the lathe of 1800 rpm and a feed rate of 0.2 mm/rev. All the test pieces manifest machinability exceeding 85%, a proper performance for a leadless bronze.

The numerical values expressing the surface ratios mentioned above may be handled substantially per se as volume ratios.

Then, in the present example, the intermetalic compound is preferred to solidify within the range of the solidifying temperature of the copper-based alloy for the sake of enhancing the soundness of alloy. Even in such copper-based alloys as 15Zn-12Sn-2Bi-0.4Se (the liquidus line about 870° C. and the solidus line about 670° C.) and 20Zn-8Sn-2Bi-0.2Se (the liquidus line about 870° C. and the solidus line about 700° C.) which have higher Zn and Sn contents than the bronze type alloy, namely the copper-based alloys in which the intermetallic compound (such as, for example, ZnSe: the melting point about 880° C.) solidifies in the temperature ranger higher than the range of solidifying temperature of the alloy, the soundness of alloy can be enhanced.

INDUSTRIAL APPLICABILITY

The copper-based alloy of this invention is applicable to various copper-based alloys, from bronze alloys and brass alloys onward. The ingot produced by using the copper-based alloy of this invention is provided as intermediates and is applied to liquid-contacting parts manufactured by forming the alloy of this invention. The liquid-contacting parts include, for example, valve parts, such as valves, stems, valve seats and disks for potable water; plumbing materials, such as faucets and joints; devices for service and drain pipes; devices, such as strainers, pumps and motors which are fated to contact liquids; liquid-contacting faucet fittings; hot water-handling devices, such as hot feed water devices; parts and members for clean water lines; and intermediates, such as coils and hollow bars other than the finished products and assembled bodies enumerated above.

The invention claimed is:

1. A bronze alloy consisting of 5.0 to 10.0 weight % of Zn, 2.8 to 5.0 weight % of Sn, 0.25 to 3.0 weight % of Bi, 0<Se<0.35 weight % of Se, less than 0.5 weight % of P, the balance of Cu and unavoidable impurities, said bronze alloy having soundness improved during a course of solidification of the bronze alloy by crystallizing ZnSe that is an intermetallic compound capable of solidifying within a range of solidifying temperature as a temperature region between a solidus line and a liquidus line surpassing the solidus line in dendrite gaps of the alloy, thereby suppressing migration of a solute and consequently effecting dispersion of microporosities and by utilizing the crystallization of the intermetallic compound ZnSe for suppressing segregation of Bi that is a low melting metal capable of solidifying at a temperature falling short of the solidifying temperature of the bronze alloy and relying on the Bi to enter the microporosities and undergo dispersed crystallization and consequently suppress occurrence of microporosities.

2. The bronze alloy according to claim 1, wherein at least 5.0 to 10.0 weight % of Zn and 0<Se<0.35 weight % of Se are contained and ZnSe is crystallized as an intermetallic compound in the dendritic gaps of the alloy during the course of solidification of the bronze alloy.

3. The bronze alloy according to claim 1, wherein the intermetallic compound has a surface ratio of 0.3% or more and 5.0% or less.

4. The bronze alloy according to claim 1, wherein at least 0.25 to 3.0 weight % of Bi is contained and Bi is crystallized as the low melting metal in a region of the solute during the course of solidification of the bronze alloy.

5. The bronze alloy according to claim 1, wherein the low melting metal or low melting intermetallic compound has a surface ratio of 0.2% or more and 2.5% or less.

6. A bronze alloy consisting of 5.0 to 10.0 weight % of Zn, 2.8 to 5.0 weight % of Sn, 0.25 to 3.0 weight % of Bi, 0<Se<0.35 weight % of Se, less than 0.5 weight % of P, the balance of Cu, and less than 0.2 weight % of Pb as an unavoidable impurity, said bronze alloy having soundness improved during a course of solidification of the bronze alloy by crystallizing ZnSe that is an intermetallic compound capable of solidifying within a range of solidifying temperature as a temperature region between a solidus line and a liquidus line surpassing the solidus line in dendrite gaps of the alloy, thereby suppressing migration of a solute and consequently effecting dispersion of microporosities and by utilizing the crystallization of the intermetallic compound ZnSe for suppressing segregation of Bi that is a low melting metal capable of solidifying at a temperature falling short of the solidifying temperature of the bronze alloy and relying on the Bi to enter the microporosities and undergo dispersed crystallization and consequently suppress occurrence of microporosities.

7. A bronze alloy consisting of 5.0 to 10.0 weight % of Zn, 2.8 to 5.0 weight % of Sn, 0.25 to 3.0 weight % of Bi, 0<Se<0.35 weight % of Se, less than 0.5 weight % of P, 3.0 weight % or less of Ni, the balance of Cu and unavoidable impurities, said bronze alloy having soundness improved during a course of solidification of the bronze alloy by crystallizing ZnSe that is an intermetallic compound capable of solidifying within a range of solidifying temperature as a temperature region between a solidus line and a liquidus line surpassing the solidus line in dendrite gaps of the alloy, thereby suppressing migration of a solute and consequently effecting dispersion of microporosities and by utilizing the crystallization of the intermetallic compound ZnSe for suppressing segregation of Bi that is a low melting metal capable of solidifying at a temperature falling short of the solidifying temperature of the bronze alloy and relying on the Bi to enter the microporosities and undergo dispersed crystallization and consequently suppress occurrence of microporosities.

* * * * *